US006572741B1

(12) United States Patent
H. et al.

(10) Patent No.: US 6,572,741 B1
(45) Date of Patent: Jun. 3, 2003

(54) ELECTROLYTIC CELL

(76) Inventors: Victor Vidaurre H., Montecasion 1021, Las Condes, Santiago (CL); Jorge Dufeu L., Nueva Costanera No. 3222 Depto. 73, Vitacura, Santiago (CL); Ricardo Mena O., Avda. Pajaritos 3277-Casa 7, Maipu, Santiago (CL); Carlos Le Fort G., Pasaje 12 No. 334-A, Villa Lorenzo Arenas, Concepcion (CL)

( * ) Notice: Subject to any disclaimer, the term of this patent is extended or adjusted under 35 U.S.C. 154(b) by 0 days.

(21) Appl. No.: 09/687,506

(22) Filed: Oct. 13, 2000

(51) Int. Cl.[7] ..... C25B 9/00; B28B 1/14; B65D 85/84

(52) U.S. Cl. ..... 204/279; 206/524.5; 264/299

(58) Field of Search ..... 204/279; 264/299; 206/524.5

(56) References Cited

U.S. PATENT DOCUMENTS

| | | | | | |
|---|---|---|---|---|---|
| 3,401,109 | A | * | 9/1968 | Anderson | 204/242 |
| 3,763,083 | A | * | 10/1973 | Grotheer | 204/279 X |
| 4,885,072 | A | * | 12/1989 | Harry et al. | 204/279 |
| 5,066,379 | A | * | 11/1991 | Harry et al. | 204/279 |
| 5,079,050 | A | * | 1/1992 | Harry et al. | 204/279 X |

* cited by examiner

*Primary Examiner*—Donald R. Valentine
(74) *Attorney, Agent, or Firm*—Christopher Darrow

(57) ABSTRACT

Design improvements in constructing electrolytic cell receptacles for electrowinning and electrorefining of nonferrous metals are disclosed. Also disclosed are formulations for three-layered polymer composite materials and surface sealing coatings, which are used in monolithic formation of receptacles or containers of electrolytic cells.

37 Claims, 13 Drawing Sheets

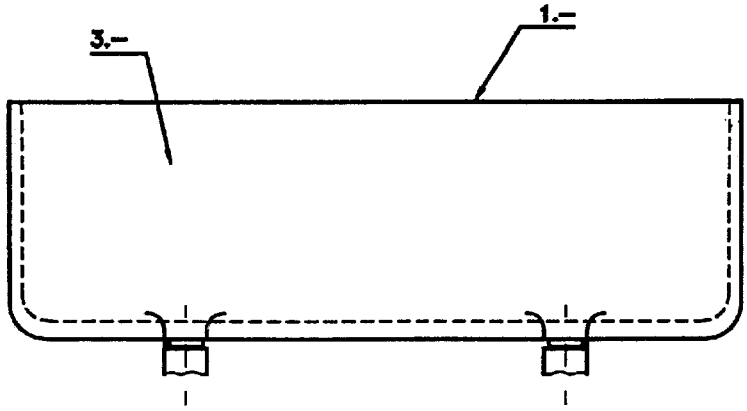
Fig. 1
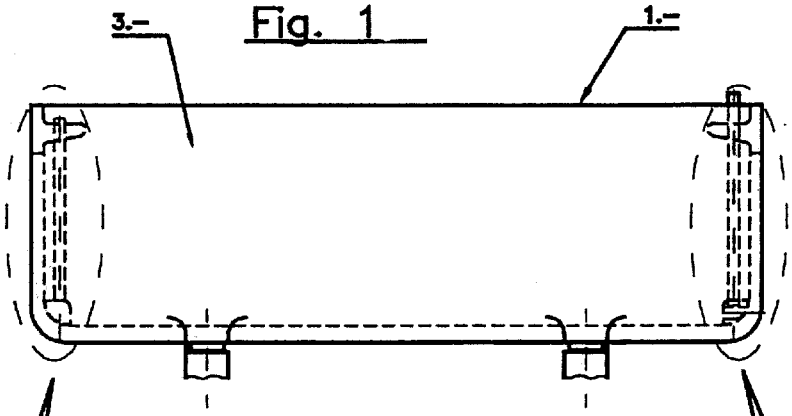
Fig. 1A
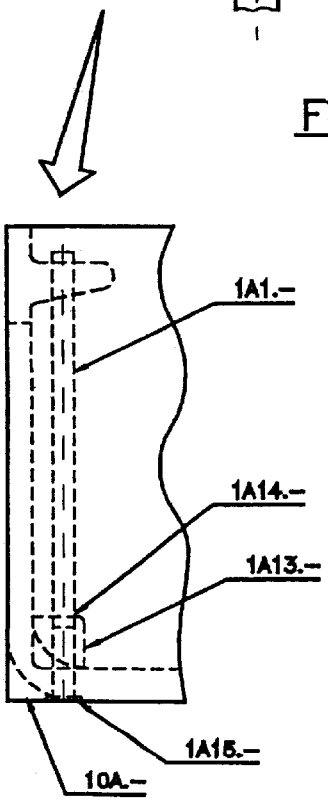
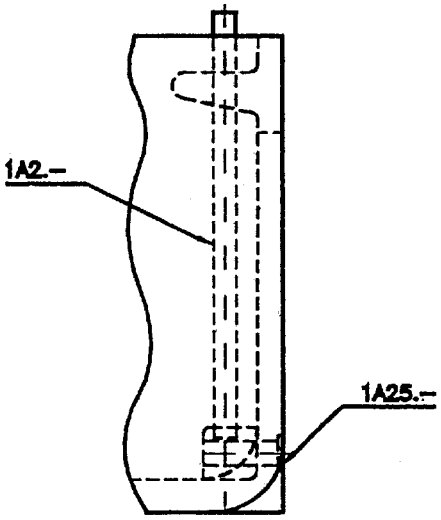

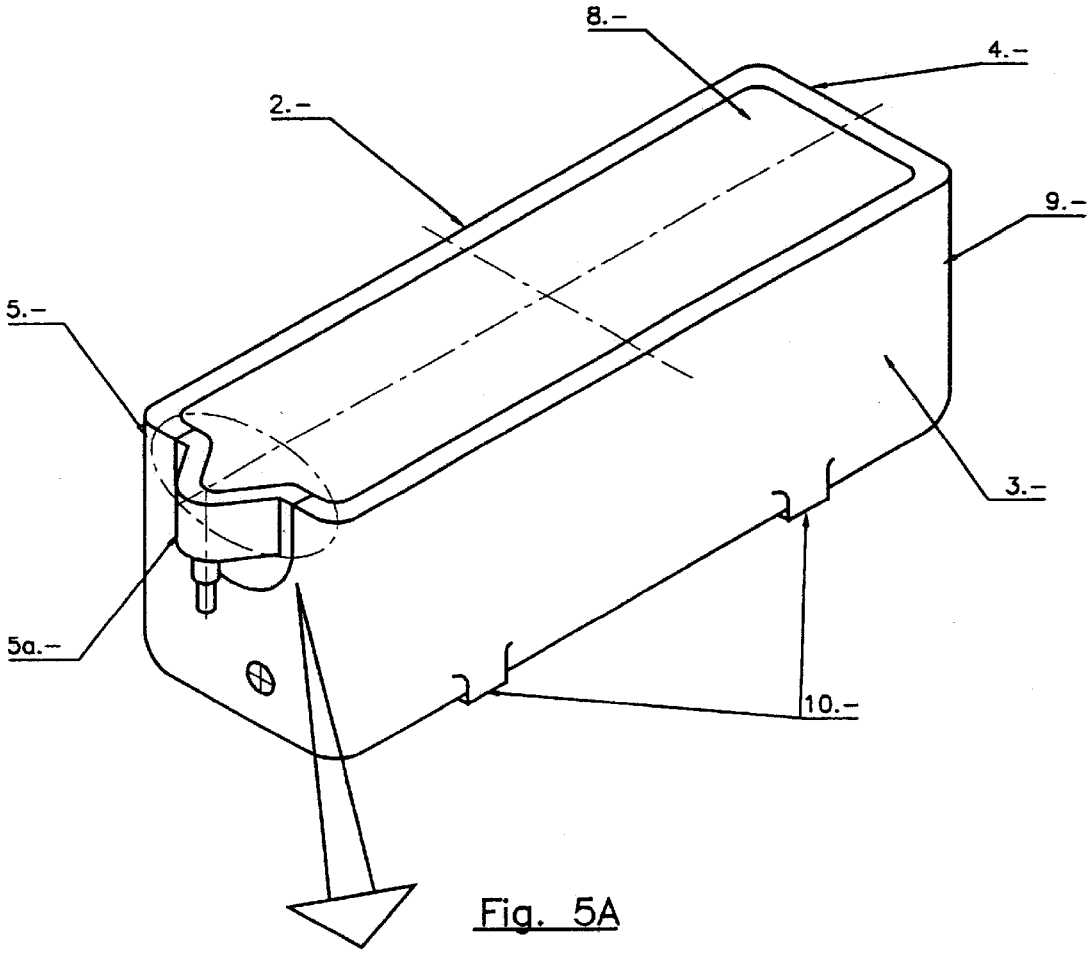
Fig. 5A
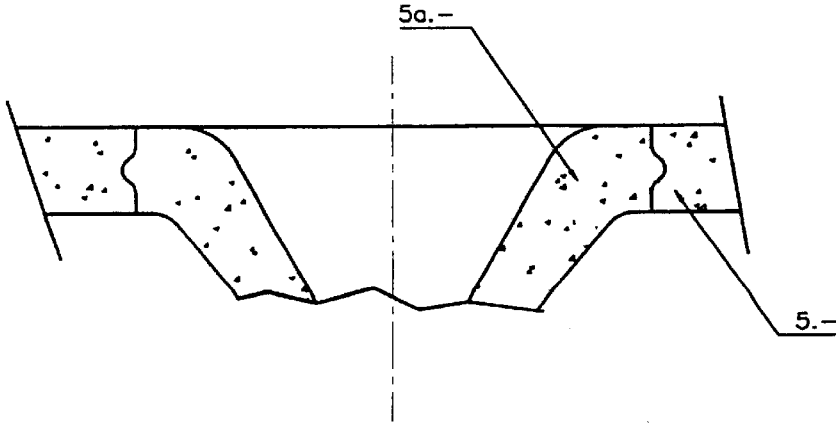

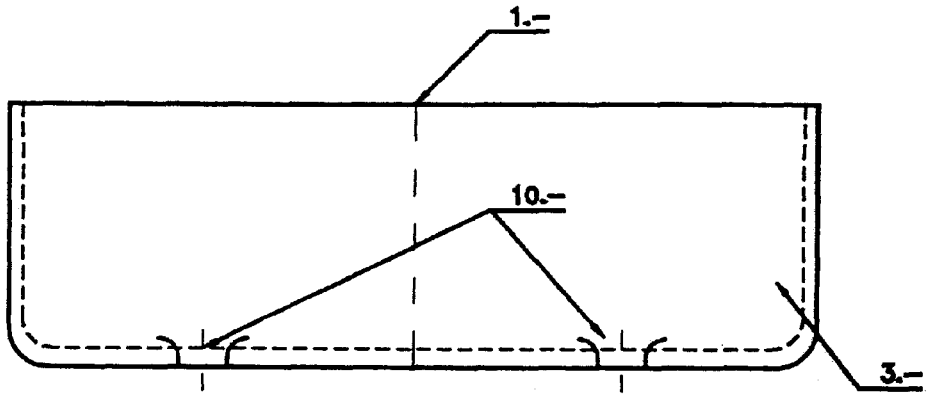
Fig. 6
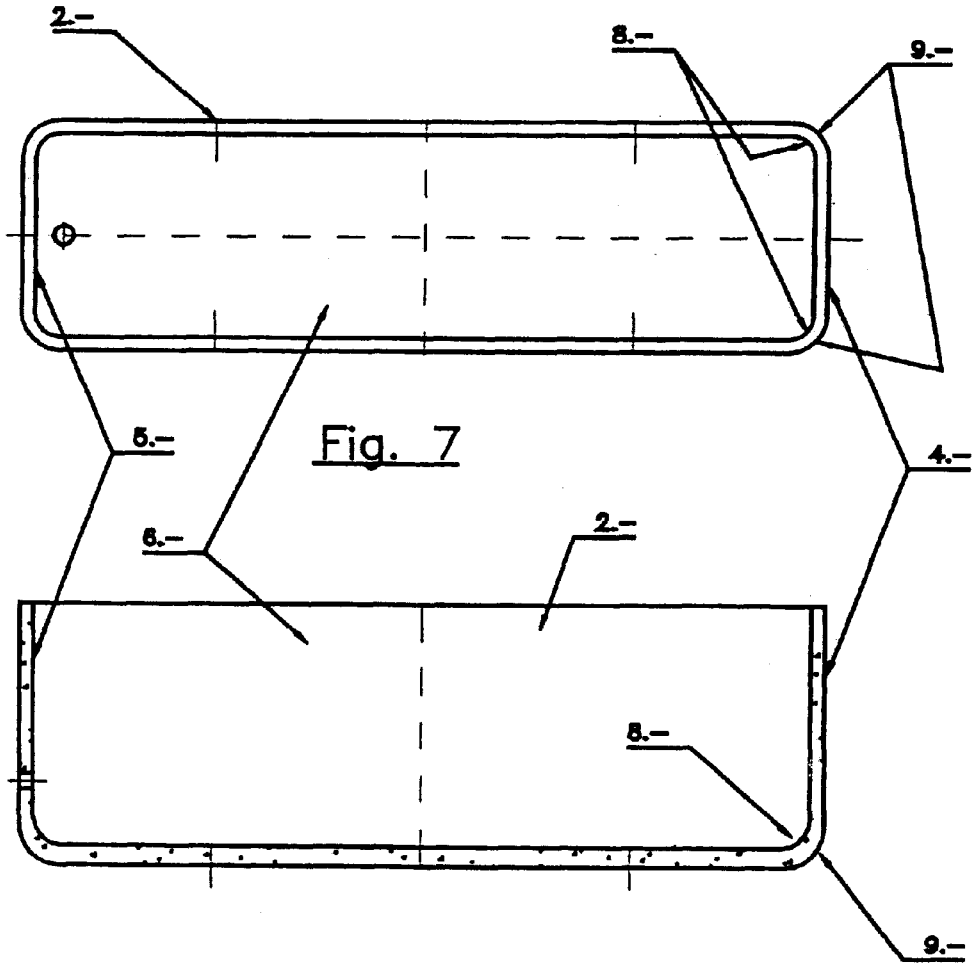
Fig. 7
Fig. 8

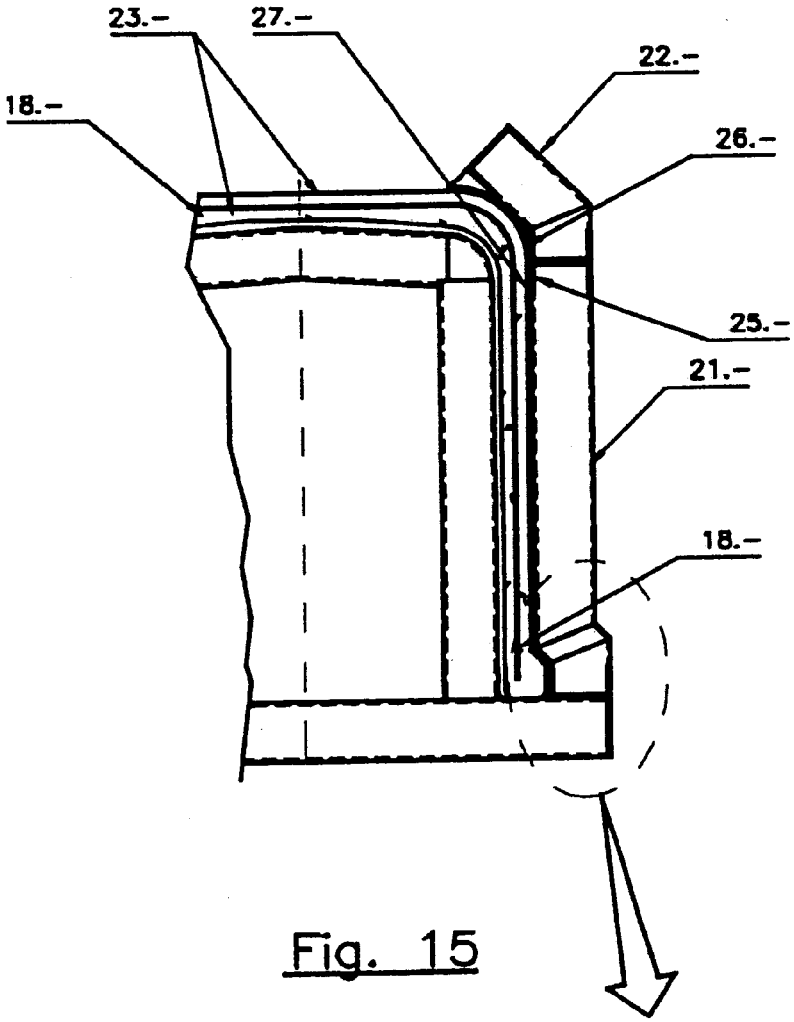
Fig. 15
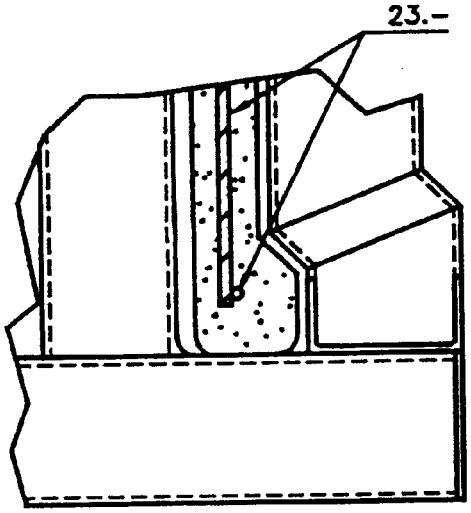

ELECTROLYTIC CELL

SPECIFICATION

The invention consists of design improvements in the construction of electrolytic cells for electrowinning and electrorefining processes of nonferrous metals, with a novel mold and molding method and new formulations for three-layered polymer composite materials for the monolithic formation of the structural core with surface sealing coatings in the receptacles or containers of such cells.

There are currently several known designs for cell-type receptacles or containers intended for electrolytic refining and winning used in the purification and recovery of nonferrous metals. In order to obtain high purity cathodic copper, there are currently 2 well-established industrial electrolytic processes: electrorefining of melted copper anodes dissolved in sulfuric acid electrolytes, and electrowinning cathodic copper directly from copper sulfate electrolytes previously recovered by hydrometallurgic processes by extraction using lixiviated copper solvents in batteries. The receptacles for electrolytic cells used in both processes are similar, having a parallelepipedic geometry, being self-supporting, with suitable dimensions to lodge electrodes in the form of vertically positioned parallel laminar plates supported at each end at the upper edges of the side walls of the receptacle, and provided with means for electrolyte infeed and overflow. The design of the electrolytic cell receptacle itself is functional in order to accommodate the specific requirements of the corresponding electrolytic process. Currently, electrorefining cells typically operate with moderate electrolyte flows, at temperatures between 55° C. and 75° C., and the length/width ratio of the receptacle, in terms of the number of electrodes required for each cell, is generally<4; electrowinning cells, on the other hand, operate with much higher electrolyte flows, at lower temperatures, between 45° C. and 55° C., and their length/width ratio is typically>4. Recent technological efforts to improve productivity of both electrolytic processes have shown tendencies toward greater current densities per electrode, higher electrolytic temperatures, and a higher number of electrodes per cell, i.e., with a length/width ratio that is typically 5 or 6.

One of the receptacles for electrolytic cells of the current state of the art is discussed in (Chilean) Patent No. 38,151, which characterizes a corrosive electrolyte receptacle or container used in electrolytic processes, where said receptacle consists of a polymer concrete box with side walls, a pair of opposite end walls, and a bottom, and each of said end walls has an inner and outer surface where a formation has been molded onto the outer surface of the end wall that extends from its upper and lower ends and that is intermediate between the sides of the wall; a depression has been formed on the upper end of the formation, which opens toward the inner surface of said end wall; and below the upper edge of the wall a generally vertical first discharge passage has been formed at a certain distance from the outer surface of the formation on the outer surface of the end wall; the discharge passage has a first opening on the end of the formation and a second opening adjacent to the lower end of the formation in order to drain off the electrolytes from the upper part of the receptacle, characterized in that it has a second passage formed in the end wall and running through the lower part of the wall to drain off the electrolytes from the lower part of the receptacle, wherein electrolytes may be removed from both the upper and lower part of the receptacle.

It also describes a formation with a second passage on the inner surface of the other end wall and forming part of the wall, said second passage running from the upper end of said wall downward to a position adjacent to the lower end, with a channel formed in the end wall and in the inner surface, with a covering over the channel that is open at its upper and lower ends, all for the purpose of distributing the electrolytes entering the cell.

In addition, a corrosion-resistant layer has been applied, which includes a surface layer of a material taken from a group that consists of vinyl ester resin and polyester resin, and a lining layer that consists of an inorganic fiber saturated with a material from a group that includes vinyl ester resin and polyester resin.

Said lining layer is made of about 20–30 wt % fiber and about 70–80 wt % resin. The inorganic fiber is fiberglass in the form of a sheet or layer, said sheet being made up of threads that are 12.7–50.8 mm long. The surface layer has a thickness of about 0.0254–0.0508 mm.

The polymer concrete consists of 10–19 wt % resin from a group that includes thermosetting vinyl ester and polyester resin. The modified resin includes 80–90% resin taken from a group consisting of vinyl ester and polyester resin, and the balance is a thinning agent, inhibitors, promoters, and a catalyst.

Finally, it describes a method that includes the phases of applying to the surface of a mold a surface layer made of a material taken from a group consisting of vinyl ester resins and polyester resins; applied to said surface layer is a lining layer consisting of a sheet of inorganic fiber saturated with a material taken from a group consisting of vinyl ester resins and polyester resins; a thermosetting resin from a group consisting of polyester resin and vinyl ester resin and an aggregate are mixed together, the mixture being continuously emptied into an inverted mold in which said surface layer and lining define the bottom, end, and side walls, thereby permitting said molded mixture to set, wherein the surfaces of the receptacle shall come into contact with the surfaces of the mold, which casts the smooth inner surfaces. Said layer is formed of threads that are 12.7–50.8 mm long and 0.0254–0.0508 mm thick. Said lining layer has about 20–30 wt % of fiber and about 70–80 wt % of resin. The aggregate includes a mixture that is 80–90 wt % of particles that are 6.35–0.79 mm in size; 10–15 wt % of particles taken from a group that consists of fine silica sand and fine silica powder and 0.9–5 wt % of particles from the group that consists of mica flakes whose approximate size is 1/64 mm and of cut fiberglass threads 6.35–3.175 mm in length. In addition, the modified resin includes 80–90% resin from the group that consists of vinyl ester resin and polyester resin, and the balance is a thinning agent, inhibitors, promoters, and a catalyst.

Another (Chilean) patent, No. 35,466, refers to a compound material for use in molding containers or structures exposed to corrosive chemicals, particularly to corrosive acids, characterized in that it contains a plastic synthetic resin with an inert particulate filler composed of no less than 70 wt % of round particles whose diameter is on the order of less than 0.5 mm, with a total weight ratio of the particulate resin to the surrounding resin of 8:1 (that is, 11.1% resin content).

In the subordinate claims, the particulate material filler is described, which includes a fraction of about 40 wt % of the total filler of particles whose size ranges from 0.5–1 mm, and a fraction of about 15 wt % of the total filler of particles whose size varies between 1–1.75 mm and 1.75–3 mm.

Another receptacle for electrolytic processes of winning or refining nonferrous metals uses the concept of an inner container made of a two-layered polymer composite material, with the body of said container being preformed on an inverted mold by several successive applications of a first polymer composite material consisting of a base of fiberglass layers saturated with high corrosion-resistant polyester/vinyl ester resin contents. As the layers of polymer composite material closest to the surface of the mold cure, the thickness of the walls and bottom of the inner container imparts sufficient structural strength so that it may itself form the core mold for the electrolytic receptacle, which is then formed in a second phase of the manufacturing process. At the desired distance from the perimeter of the inverted inner container (acting as core mold), vertical molds are installed to vertically form the side and end walls and the thickness of the bottom of the electrolytic receptacle. The volume of the cavities defined by the molds so assembled is filled all around the inner container with a second polymer composite material based on a mixture of polyester/vinyl ester resin reinforced with particulate aggregate. The assembled receptacle is mechanically vibrated to compact the polymer concrete around the inner preformed container of fiberglass-reinforced polymer composite material. When the mass of the surrounding second polymer composite material cures, it does so joined to the outer layer of the first fiberglass-reinforced plastic material of the inner container/mold, thereby producing a chemical bond between the two polymer composite materials.

Although electrolytic cells constructed of polymer materials of the state of the art provide such advantages as improved ease of operation, productivity, and lower costs when compared to the cement concrete cells with corrosion resistant coatings of lead or plastic that they replaced, they still present significant disadvantages and technical shortcomings. The electrolytic cells of polymer concrete constructed according to the technology and the patents cited have experienced massive failures in various copper electrorefining and electrowinning plants in Chile, North America, and Europe. Defects persist in regard to both the absolute impermeability required of the cells while in operation, and significant variability in tolerances as to dimensions, structural strength, durability over time, as well as high manufacturing costs. The high costs result from the use of expensive polymer compound materials together with frequent and costly factory finishes, as well as a higher volume of polymer concrete material applied in the construction of the receptacle than is strictly necessary, which makes them heavier than the receptacles for cells of the proposed design according to the invention; as well as defective or non-existent chemical barriers or surface seals, and poorly specified structural reinforcement on the polymer concrete of the receptacles, which significantly affect their impermeability, safety, and durability and makes them difficult to clean, maintain, and above all to successfully repair cracks, so as to be able to recover their impermeability reliably.

The most important defects that cause premature breakdown and, in general, low reliability in the performance of the current polymer concrete electrolytic cells may be traced to such defects as:

Non homogeneousness and inconsistencies in the structural polymer concrete. These defects may be directly attributed to insufficient specifications and lack of rigorous control over raw materials, to deficient formulations for the polymer composite materials with excess resin, to mixing processes that are not homogeneous, and curing that lacks uniformity or is defective in regard to excessive solidification contraction, porosity due to improper compacting of the mixture in the mold, cracks due to irregular contraction of the polymer composite materials, cracks caused by defective molds, etc.

Added to the above-mentioned defects in the material and in forming and molding processes are ineffective mold designs that consistently produce cell receptacles that present variable nominal measurements and often random deformed geometry as well, which makes it more difficult, costly, and time-consuming to install and level them on site; the current state of the art views molds as devices that merely impart shape and not as true chemical reactors, whose characteristics affect the curing, properties, and condition of the composite polymer material; as a consequence of the above, the internal stresses in the material of finished cells according to the current state of the art are unacceptably high, particularly because the finished cells are not post-cured, which leaves them more susceptible or disposed to early breakdown due to cracks developed in the material during handling, shipping, and installation of cell receptacles made of a characteristically fragile material.

To the foregoing, we can add cell receptacle designs that are characterized by a parallelepipedic geometry with excessively thick walls and bottoms, particularly on the front and bottom walls as compared to the side walls, formed on the basis of materials with high resin content, and above all with the forms of the receptacle walls and bottom characterized by horizontal and vertical vertices with acute edges. The distribution of the volume of the material in conventional parallelepipedic geometry with acute vertices is not optimal for resisting the stresses to which cells are subjected, particularly thermal stresses caused by the contraction/expansion of the polymer concrete resulting from thermal gradients or differences between the temperatures of the inner surfaces in contact with hot electrolytes and the outer surfaces exposed to the outside environment or to contiguous cells. These thermal gradients, or, their sudden changes, may often cause cracks or fissures in the polymer concrete of the stressed bottom or walls which travel through current inner coatings and seals, resulting in leaks of corrosive electrolytes; and defects in regard to the cells being securely supported by and attached to their foundations, in order to ensure good seismic resistance and to protect the integrity of the cells during significant seismic events.

Finally, the internal reinforcement of the polymer concrete structure is under-specified with categories of materials that are not sufficiently corrosion resistant to sulfuric electrolytes, and are also defectively designed and installed merely to provide nominal protection to prevent disintegration of the cell material in the event of seismic catastrophes (catastrophes that, fortunately, have not yet occurred), and not for their primary function (in the event fissures in the material were to develop), which is to keep to a minimum the spreading of any fissures encountered in the material, so as to permit recovery of the structural integrity and impermeability of the cells by injecting liquid resin in the cracks. As the injected resin cures, it contracts and closes the fissure, adhering the material and sealing any leaks from the cells, thereby ensuring their impermeability; the reinforcement material is often based on fiberglass, which has very low resistance to acid corrosion by sulfuric electrolytes (Class E), and this fiberglass is also improperly dosed or poorly applied, which contributes to the formation of fissures and the loss of impermeability of the cells in the medium term.

None of the above-mentioned problems or disadvantages are fully or coherently resolved by the current state of the art.

The advantages of the improved electrolytic cells according to the invention are as follows:

With the feedback of results and problems encountered in the past 10 years concerning some 14,000 polymer concrete cells in plants for the electrorefining and electrowinning of copper, it has been possible to determine that the greatest structural stress to which cells are subjected during operation is thermal in origin and is generated by the effect of the difference between the temperature of the electrolytes inside the cell and the temperature of its external surroundings, creating temperature gradients on the inner and outer surfaces of the walls and the bottom of the cell. The concentrations of typical tensile stresses in specific areas of the electrorefining cell are, for example, more severe (indicated by structural analysis using the finite element method and taking into consideration relatively higher operating temperatures—typically 58–75° C.), and are generated by these thermal gradients between the temperatures on different areas of the inner surfaces and between them and the outer surfaces of the structural core of polymer concrete material of the walls and bottoms of the cells. In the invention, these are significantly reduced or eliminated by three strategies applied individually or jointly:

A) Introducing in the design of the receptacle wide radii of curvature in all intersections or vertices of the walls and between the walls and the bottom.

B) Introducing in the manufacture of the receptacle the application of at least two polymer composite materials in the monolithic construction of the core of three-layered polymer composite material, which are compatible while still presenting different properties.

C) Introducing sealing layers of resin reinforced with fiber glass as continuous coatings on the inner and outer surfaces of the polymer concrete structural core of the receptacle, with at least 3 structural layers over all inner surfaces and, of course, also reinforced according to industry standards in specific areas or places as joints on overflow boxes or electrolyte feed systems.

In addition, the most important structural stresses to which empty cells are subjected result from point or concentrated overloads of a mechanical nature in their handling, shipping, storage, and installation, or of an accidental nature (drop of electrodes), as well as thermal overloads due to significant sudden and/or localized drops in temperature (thermal shock). The vulnerability of cells to such overloads increases in direct proportion to their length/width ratio.

The design of the improved electrolytic cell receptacles of the invention has been simultaneously optimized both structurally and in regard to corrosion resistance, with absolute impermeability and minimizing heat loss during operation. To achieve these four objectives, computer modeling and analysis according to the finite element method have been used, with temperature data obtained directly from electrolytic processes in industrial operations. Such analysis establishes the essential conditions needed to achieve lightened stresses on the structural material workload with minimal concentrations of stresses during the working life of the receptacle, taking into account all the most severe real operating conditions that are typical in both processes of electrorefining and electrowinning as well as the normal service and handling of both types of empty cells. The optimization of the receptacle is generic and concerns the selection of a combination of such relevant parameters as geometric form, spatial distribution of the volumes of material in such geometric forms, and characteristics and stability of the properties of both the polymer concrete core material and that of the integrated seals that form the three-layered polymer composite material, in such a way as to combine together to significantly increase impermeability, ease of operation, safety, and durability of operation of cells for electrorefining and electrowinning copper and other nonferrous metals at lower cost.

As the only way to achieve improved reliability, ease of operation, and durability of the cells, only those raw materials shall be used that are certified as to their origin, specification, and compatibility, with proven mechanical and chemical suitability for application in cells with corrosive electrolytes; the certification of raw materials and other materials is fundamental to the application of quality assurance standards in all processes and instructions for manufacturing, storing, shipping, and handling.

The ratio of resin/aggregate content in the formulations for polymer concrete materials is reduced, which results in significant improvements in their mechanical properties at the same time as it reduces the cost of the structural core of the receptacle, particularly when we consider that the cost of resin represents at least 70% of the cost of the polymer concrete material.

Resistance to corrosion is significantly improved, and at the same time the absolute impermeability of the receptacles is more than insured over the long term.

Using a three-layered polymer composite material that incorporates monolithic continuous seals on both surfaces, inside and outside the structural core, and mesh reinforcement, all specifying fiberglass of the corrosion resistant (E-CR or similar) class, designed and constructed according to international standards in force in the industry for receptacles of polymer composite materials with high resistance to chemical corrosion.

The formulation of the polymer composite material for the inner chemical barrier seal to insure the absolute impermeability of the receptacle is empirically determined so that the elongation and tensile strength of the multi-layered polymer composite material applied as an inner seal is significantly higher than the adherence of its interface with the polymer concrete material of the structural core, so that any crack that may occur in the polymer concrete structural core is never able to affect the continuity and integrity of the material of the inner seal of the receptacle, thereby insuring absolute impermeability.

Elimination of all inserts, common in the current state of the art, which pass through the seals on the inner surface of the receptacle in contact with electrolytes.

The attachment of the cell to its supports is improved, with a design that ensures restricted movement in both senses in all three directions, without resorting to metal inserts, by incorporating a system based on a "fuse" component designed to collapse when subject to high stress during significant seismic events, thereby protecting the integrity of the cell.

Depending on which cross-sectional geometry of a conventional cell is used as a reference—for example, the one claimed in (Chilean) Patent No. 38,151—the application of the design of the invention having wide interior and exterior curves to the current horizontal and vertical vertices of the structural core also permits a reduction on the order of 10% in the overall volume of material applied in the new cell receptacle, and accordingly also reduces its weight when compared to the typical reference cell, again lowering costs.

Nevertheless, the overall reduction in the level of stresses (both mechanical and thermal) and the optimal distribution of the volume of the material by using radii at the vertices to prevent the concentration of stresses significantly improve the safety features of the new cell under electrorefining and electrowinning operating conditions.

A basic design concept of the improved electrolytic cell receptacle of the invention is to avoid any concentration or localization of discrete volumes of polymer concrete so as to achieve a clean simple receptacle with uniform thicknesses, moderate transitions, and ample radii in order to thereby manage setting contractions and insure complete and homogeneous curing and easy removal from the mold, and to provide electrolytic cell receptacles for operation that are as relaxed or as free of internal stresses as possible.

In order to improve the distribution of stresses in the polymer concrete core, and above all, in order to be able to reliably repair any possible fissures in the structural core cells produced by catastrophic events, a prewoven mesh is incorporated in the structural core in order to provide bidirectional reinforcement in the plane of the mesh. This prewoven mesh for bidirectional reinforcement is preferably formed of a framework of fiberglass rods of the E-CR class resistant to acid corrosion, pultruded with vinyl ester resin, with a square or hexagonal class section, twisted, or with a circular cross section and surface fibers applied in a spiral braiding, with predetermined spacing and points of contact between the rods of the prewoven mesh adhered using vinyl ester resin. The prewoven mesh is applied before emptying the polymer concrete over the continuous coating seals on the surfaces of the core mold, onto the side and end walls and below the outer surface of the bottom. The spacing of the framework on the bottom plane is denser in order to help ensure the integrity of the bottom material of the cell receptacle during the solidification process of the already consolidated polymer concrete, so as to uniformly distribute contractions and to prevent the formation of cracks caused by setting contractions, which is typical of polymer concrete cells manufactured according to the state of the art.

The improved characteristics of the construction of electrolytic cells with non monolithic overflow and electrolyte infeed systems, mold and molding method, and new formulations for three-layered polymer composites shall be better understood in descriptions with reference to the drawings that form an integral part of the invention:

FIG. 1 shows a side view of a receptacle for cells of the invention, without showing the means for electrolyte infeed and overflow/drainage.

FIG. 1A shows a longitudinal section of a cell for electrorefining processes, with electrolyte overflow/drainage system (1A1) and infeed system (1A2) oriented toward the inside of the end walls.

Figure 1B:
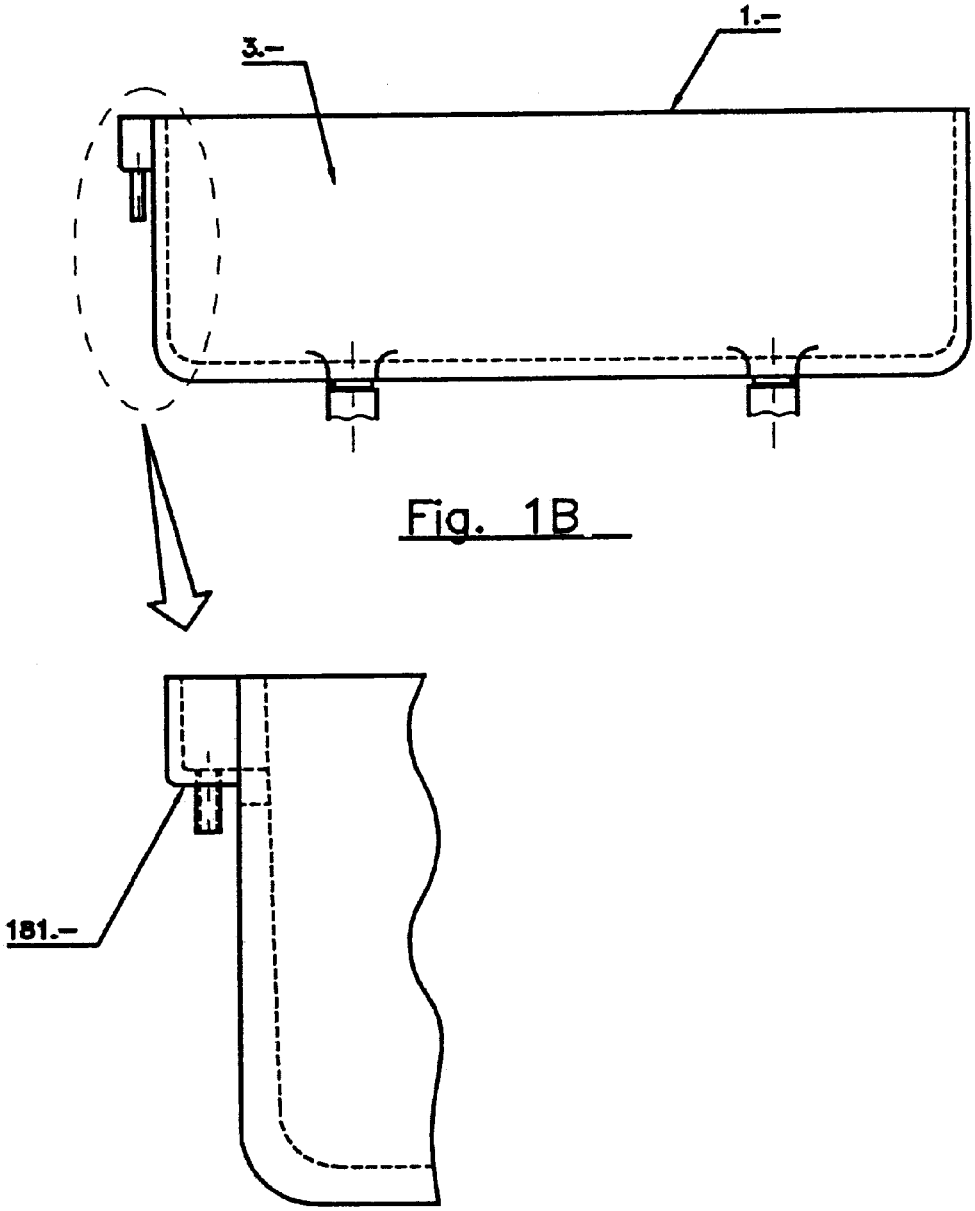
FIG. 1B shows a side view of a cell for electrowinning, and the detail of the design with a non monolithic overflow box on the receptacle (1B1) draining toward the outside of an end wall.
Figure 2:
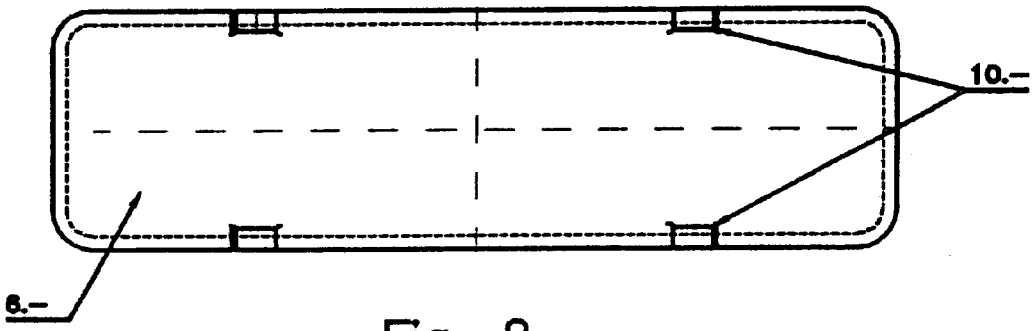
FIG. 2 shows a bottom view of the electrolytic cell receptacle of the invention and the areas for seismic-resistance support.
Figure 3:
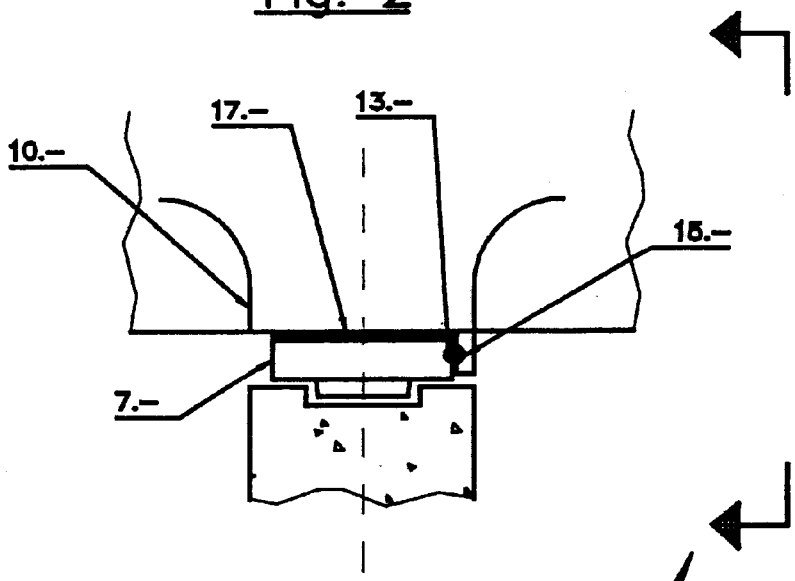
FIG. 3 shows a detail of the support block and the attachment system with a fastener of the cell receptacles of the invention.
Figure 4:
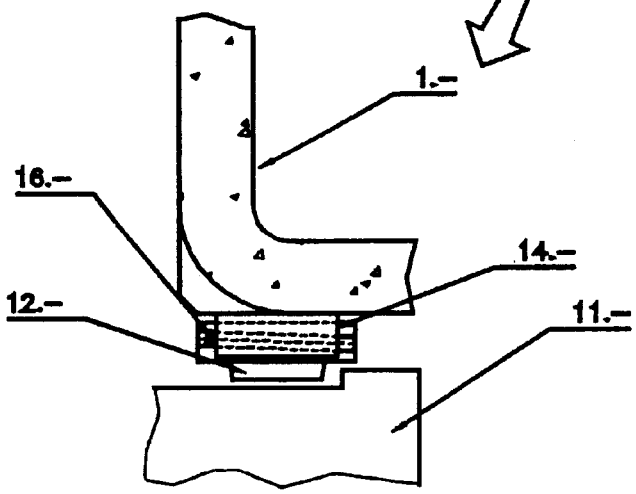
FIG. 4 shows a side view of the attachment system with a fastener of the cell receptacles of the invention.
Figure 5B:
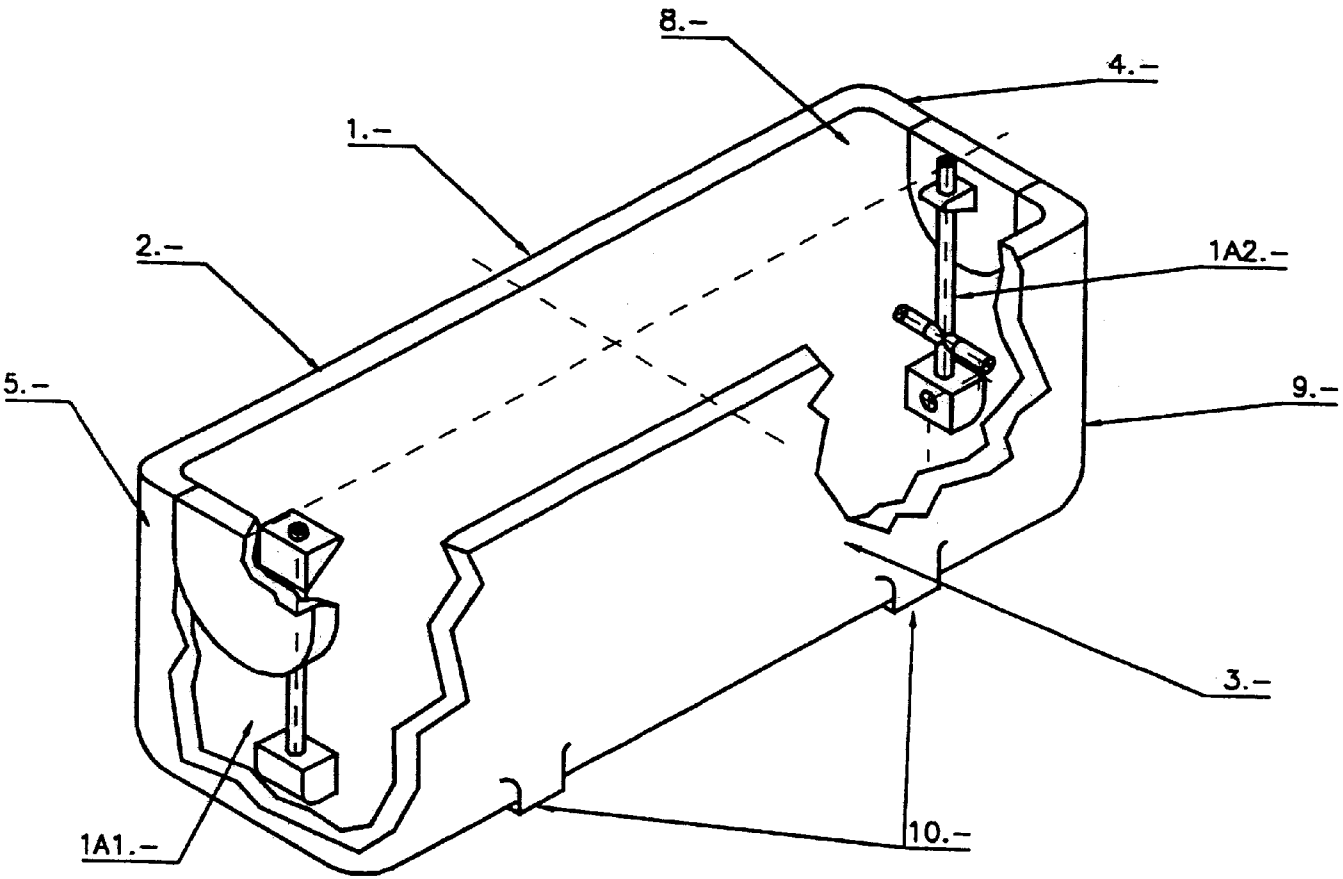
FIG. 5A shows a perspective view of a cell of the invention for electrowinning, indicating each of its walls and vertices, the areas of seismic-resistance support, and a detail of the installation of the non monolithic overflow box on an end wall.

FIG. 5B shows a perspective view of a cell according to the invention for electrorefining and a detail of the installation of the overflow/drainage system with discharge tubing at two levels, the first for overflow and the second at a level for storing sludge, defined by a formation inside the bottom of the receptacle; and of the electrolyte infeed system, both systems being installed toward the inside of the end walls.

FIG. 6 shows the right side wall of the receptacle of the invention and its supports.

FIG. 7 shows a top view of the receptacle of the invention.

FIG. 8 shows a longitudinal section of the receptacle of the invention.

Figure 9:
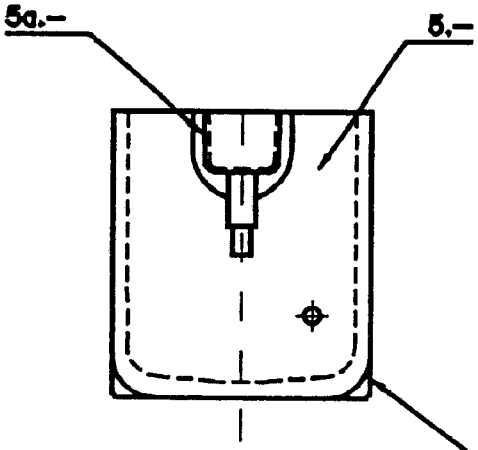

FIG. 9 shows the front overflow wall as seen from the outside of an electrowinning cell of the invention.

Figure 10:
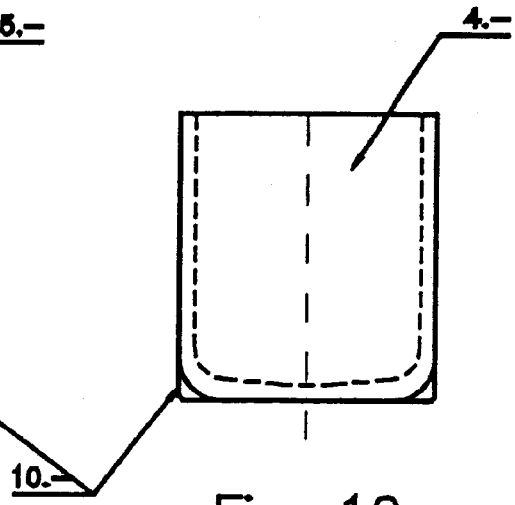

FIG. 10 shows the front electrolyte infeed wall as seen from the outside of a cell of the invention.

Figure 11:
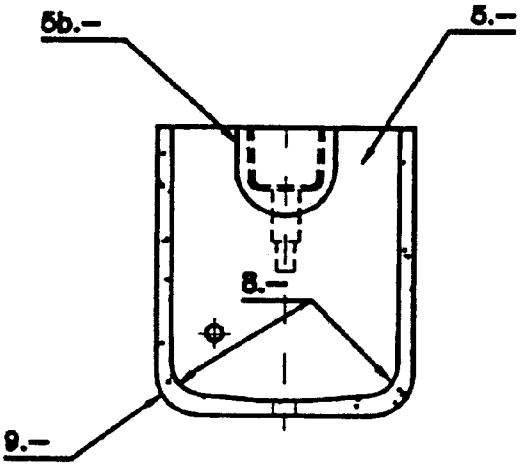

FIG. 11 shows a front overflow wall as seen from the inside of an electrowinning cell of the invention.

Figure 12:
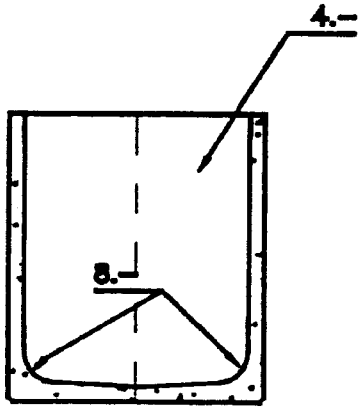

FIG. 12 shows a front electrolyte infeed wall as seen from the inside of an electrowinning cell of the invention. The section view shows the cross section at the supports.

Figure 13:
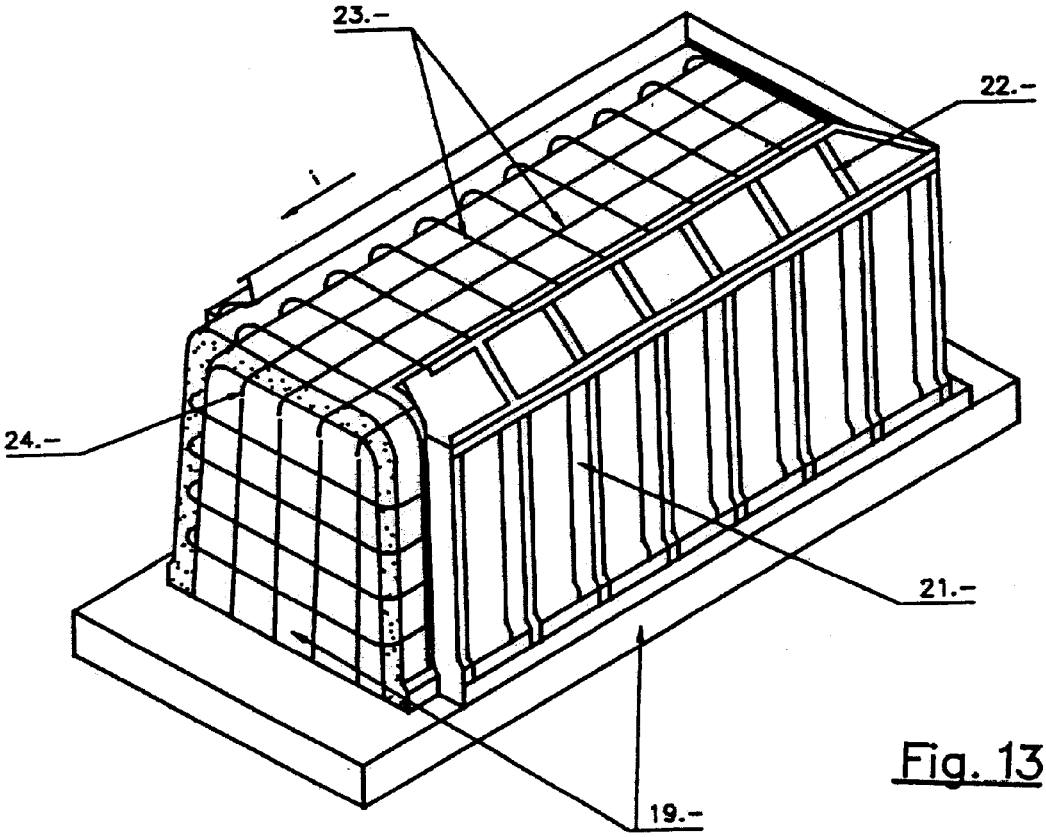

FIG. 13 shows a perspective view of a core mold and its assembled side walls; visible on the core mold is the pre-woven bi-directional reinforcement mesh on the bottom and walls of the cell receptacle of the invention.

Figure 14:
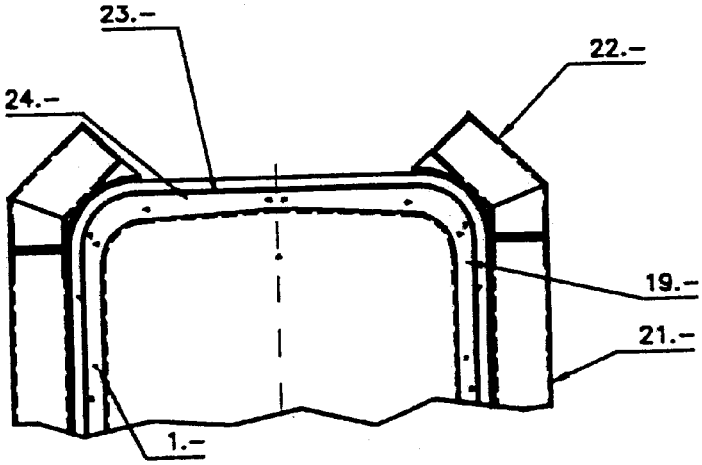

FIG. 14 shows two sections of the side walls of FIG. 13, in other words, the part that gives rise to the straight sections of the side and end walls, and the part that gives rise to the lower outside perimetric curvature of a cell receptacle embodiment of the invention; also visible is the pre-woven bi-directionally reinforced mesh.

FIG. 15 shows how the two sections of the side walls of the mold of FIG. 13 are assembled together; also showing the continuity of the outer seal coating installed over the entire section of the wall; and a detail of the pre-woven mesh on the upper edge of the side and front walls of the cell of the invention.

Figure 16:
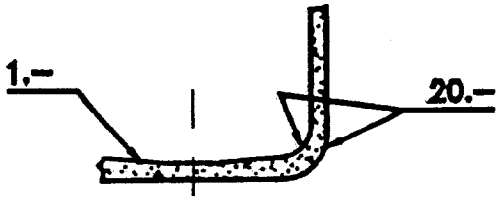

FIG. 16 shows a cross-sectional view of a lower longitudinal vertex of a receptable of the invention, formed by an inner radius and an outer radius.

Figure 17:
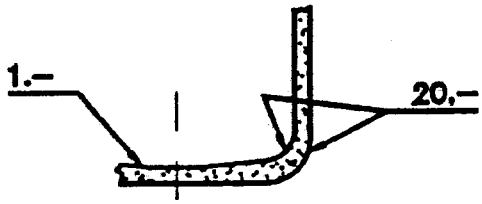

FIG. 17 shows a cross-sectional view of a lower longitudinal vertex of a receptable of the invention, whose inner and outer radii are formed by 2 or more different radii.

Figure 18:
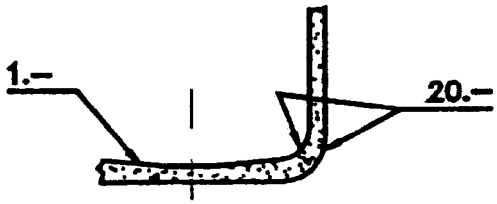

FIG. 18 shows a cross-sectional view of a lower longitudinal vertex of a receptable of the invention, whose side wall and bottom are joined by means of 3 or more straight segments that generate regular segments.

Figure 19:
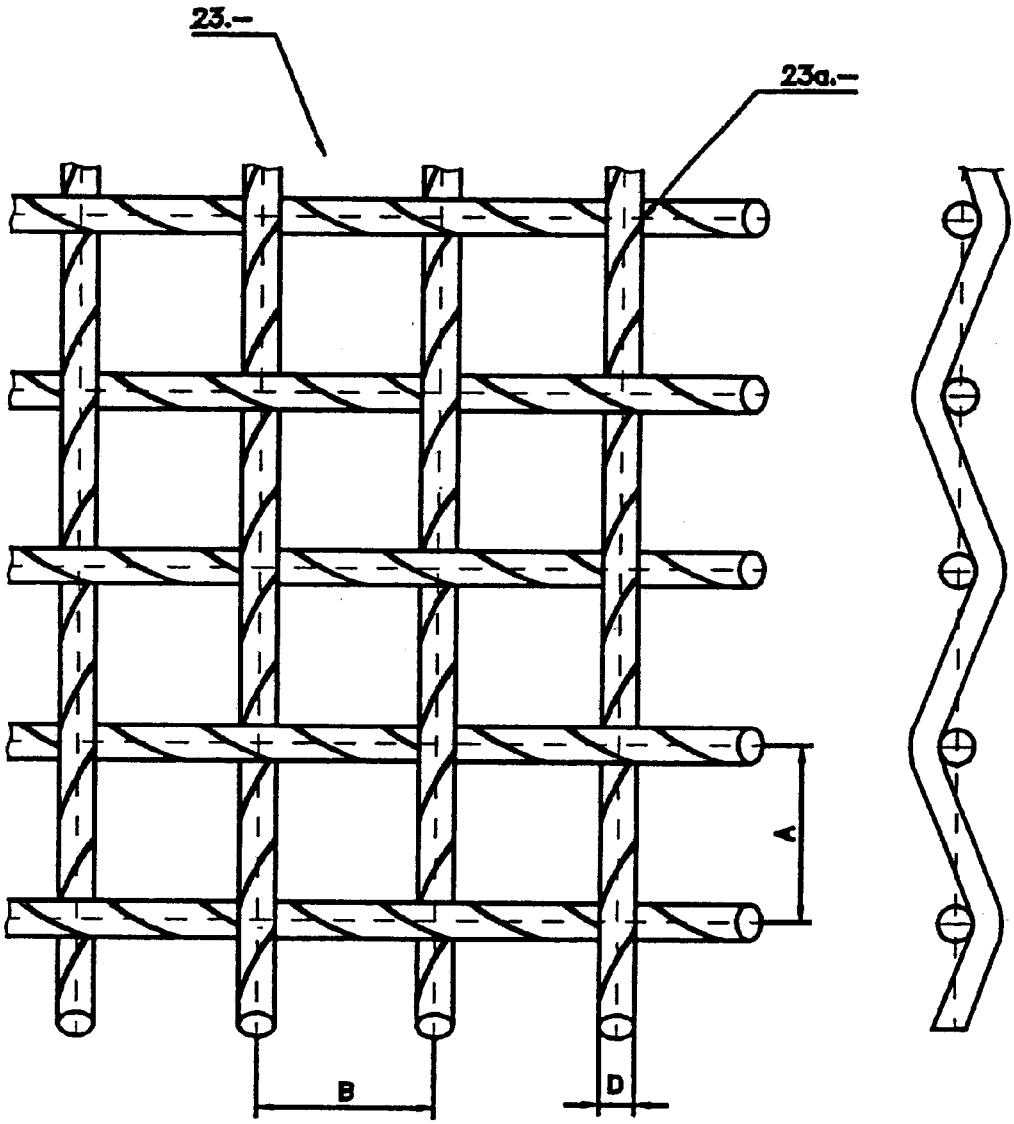

FIG. 19 shows a plan and side view of a new type of pre-woven bi-directionally reinforced mesh with pultruded, fiber reinforced polymer rods of circular cross section and with fibers with helicoidal twisted ribs, showing a section of the weave and an appropriate diameter of rod for the levels of stress required.

Figure 20:
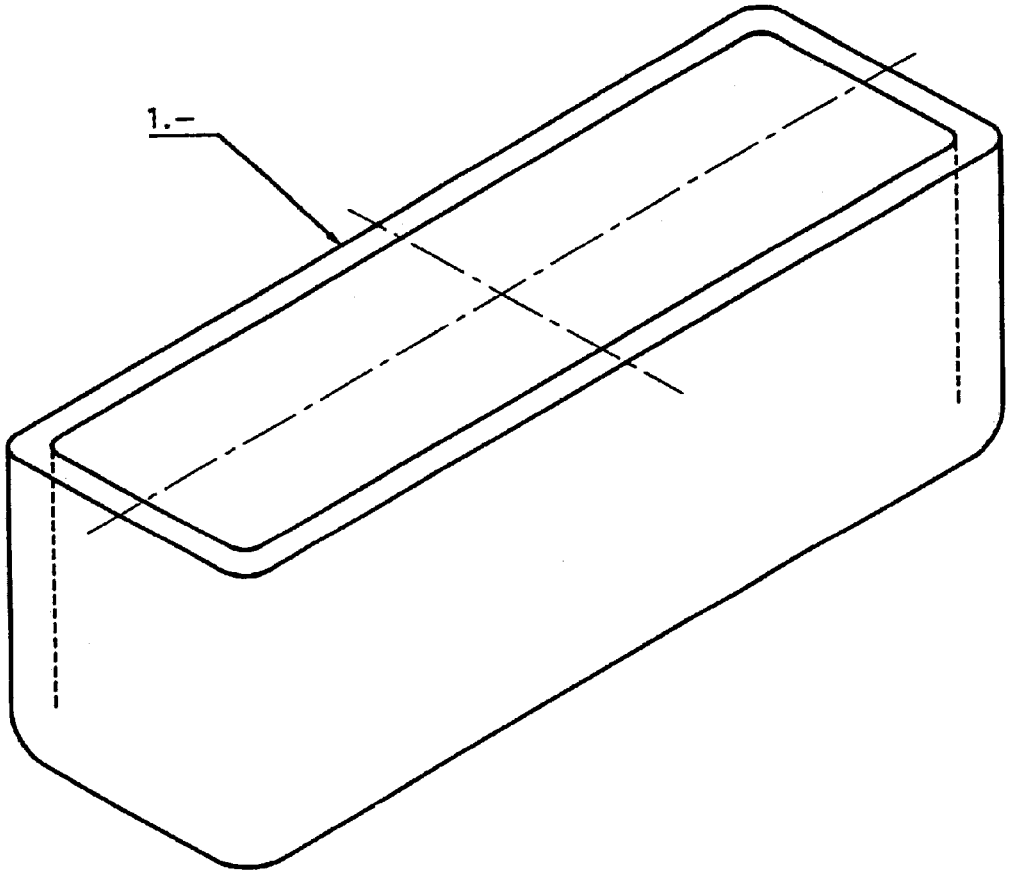

FIG. 20 shows a perspective view of a typical receptacle for an electrolytic cell of the invention, which may be equipped for either electrorefining or electrowinning, incorporating in each case corresponding typical electrolyte overflow/drainage and infeed systems on the end walls.

Figure 20A:
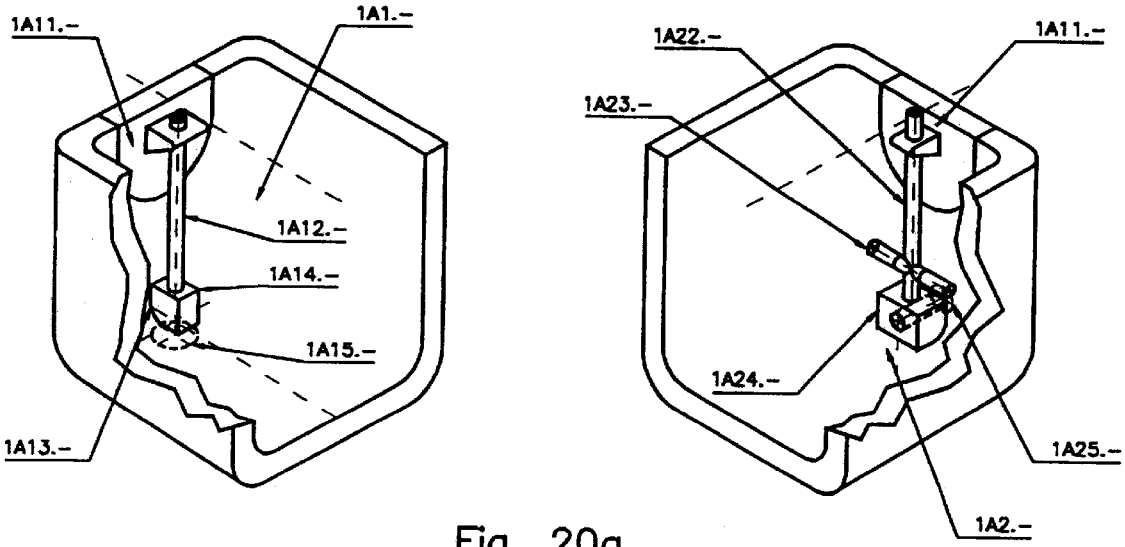

FIG. 20*a* shows a perspective view of a detail of an overflow/drainage system with common tubing and discharge of the type of FIG. 5B of the electrorefining cell embodiment of the invention.

Figure 20B:
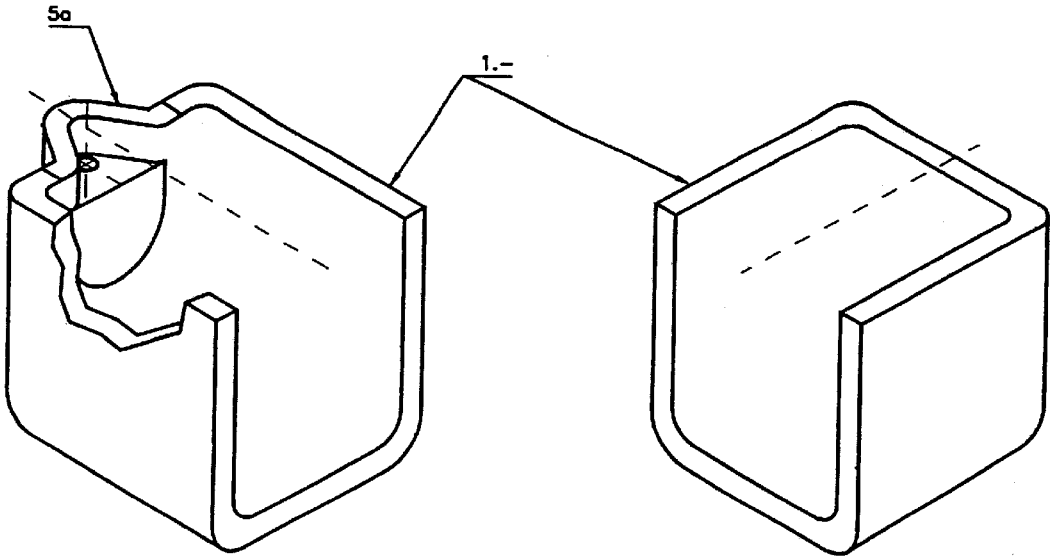

FIG. 20*b* shows a perspective view of an inner end wall of an electrowinning cell with a non-monolithic overflow box as seen from inside.

With reference to FIGS. 1–20*b*, electrolytic cell receptacle (1) for processes of electrowinning or refining nonferrous metals of the invention is composed of side walls (2) and (3), end or front walls (4) and (5), bottom (6), and support system (7), and non monolithic overflow box installed after the receptacle has been molded and has hardened (5A) on end wall (5) or non monolithic overflow/drainage system (1A1) and electrolyte infeed system (1A2), also installed after the receptacle has been molded and has hardened.

In order to equip the receptacle of the invention for the electrorefining process, the overflow/drainage system and the electrolyte infeed system are designed as indicated in FIG. 20*a*. The overflow/drainage system is composed of a unit that is molded separately from receptacle (1) and consists of a semicircular wedge piece on end wall (5), which is integrally molded with buffer block (1-A 11), provided with a hole for vertical installation of drain pipe (1-A 12). Said pipe is inserted at its lower end into block (1-A 13) separately molded and adhered to the floor of receptacle (1), or integrally molded with bottom (6) of receptacle (1). Block (1-A 13) is provided with vertical discharge hole with flange (1-A 15) toward the outside of the receptacle. At the level of the block, a conical rubber ring is installed on the outside of pipe (1-A 12) in order to support pipe (I-A 12) and at the same time to seal access to hole (1-A 15), thereby preventing runoff of the electrolytes when the overflow pipe is installed. In order to drain electrolytes from the cell, pipe (1-A 12) rises vertically toward its open end over buffer block (1-A 11), thereby permitting electrolytes to drain through hole (1-A 15). The accumulated sludge remains in the bottom of the cell and is discharged by a second hole (not shown) located conveniently in the bottom of receptacle (1). The electrolyte infeed system is composed of another very similar unit that is molded separately from receptacle (1) and consists of a semicircular wedge piece on end wall (4) which is integrally molded with buffer block (1-A 11), provided with a hole for vertical installation of infeed pipe (1-A 22). The lower end of said pipe is inserted in block (1-A 24), which is separately molded and adhered to the floor of receptacle (1), or integrally molded with bottom (6) of receptacle (1). Block (1-A 24) is provided with a horizontal hole of large diameter (1-A 25), which is connected outside to the system for rapid filling the cell with electrolyte. Vertical pipe (1-A 22) may be equipped at a convenient height with "T" piece (1-A 23) for installing horizontal supply pipes that distribute the electrolyte as desired or in a manner favorable to the electrorefining process. The supply arrangement may be replaced with a vertical supply box or channel (not shown) adhered to end wall (4) below or adhered to buffer block (1-A 11).

FIG. 20-*b* shows receptacle (1) equipped with a wide overflow box designed to accommodate the larger electrolyte flows of electrowinning processes, which generally discharge toward the outside of the cell through a pipe of suitable diameter, as shown in FIG. 5-A.

Incorporated on the side and front walls of electrolytic cell (1) are inner radii (8) and outer radii (9) located at the intersections of said walls, and outer radii (9) are optionally added at the intersections of the walls and bottom (6), the thickness of the walls either remaining constant or gradually changing at the intersections with bottom (6), except in areas of seismic-resistance support (10) for the cells to their foundations or drainage areas (10A).

The fastening system for the innovative electrolytic cell (1) eliminates current state of the art inserts in the receptacle and anchoring bolts to the support block and permits the cell to be mounted onto conventional foundations (11) by an arrangement of adhered polymer concrete blocks, which make it possible to provide fasteners with pins (16) restraining movement in both directions of the three orthogonal planes, which simultaneously act as seismic fuses. This is achieved by using conventional support blocks with teeth (12) made of polymer concrete, whose formulation is similar to that of the core, into which is molded a female half-channel (13) running obliquely longitudinal, to work together with four adjacent seismic stops (14) provided with female half-channels (15) that are the mirror image of the previous ones, which are positioned, once the blocks and seismic stops are installed, in such a way that the cavities formed by the opposing half-channels define an oblique bore that will permit the cell to be fastened to and unfastened from the support blocks by means of pins (16), preferably PVC tubes filled with polymer concrete. Fuse stops (14) are adhered to the bottom of the cell receptacle on site after having leveled support block (12) and cell (1) with shims (17), so that half-channels (13) and (15) are opposite one another and perfectly aligned so as to permit insertion of seismic fastening pin (16), regardless of the height of the shims (17) used to level the blocks (and the cell) in each cell (1) support. The alignment of the facing half-channels is achieved by the fact that fusible seismic stop (14) is able to slide on support pedestal (10) of cell receptacle (1) until the facing longitudinal axes of half-channels (13) and (15) are aligned. Adherence on site of fusible stops (14) makes it possible, if a seismic event were to occur, for them to collapse and/or detach from the cell receptacle in order thereby to protect the integrity of bottom (6) of cell receptacle (1), since the energy is dissipated primarily in the seismic fuse stops and in the fastening pin.

The typical formulation for the polymer concrete material of the structural core of cell receptacle (1) of the invention is characterized by the fact that it has a low resin content, with a maximum of 9.5 wt % of the material. The resin system preferably consists of a mixture of at least 90 wt % vinyl ester resin (5% elongation) and the balance of other compatible resins with high elongation (50–70% elongation), including polyester/vinyl ester. The solid reinforcement for the resin system is characterized by a system of siliceous aggregates, dosed in a controlled manner according to a continuous diametral gradation of fractions of multiform particles, in a range from a maximum diameter of 12.67 mm to a minimum diameter of 1 micron, with or without incorporation of between 0.1–0.8 wt % of filament-shaped reinforcement, typically fiberglass cut to lengths between 6.35 mm and 3.175 mm. As needed in high stresses areas of the cell, according to the structural analysis, and so as to be compatible with the typical polymer concrete material used in the core, the invention calls for formulations for polymer composite materials with higher vinyl ester resin contents reinforced with a system of siliceous aggregates, dosed in a controlled manner, according to a continuous diametral gradation of fractions of multiform particles, in a range from a maximum diameter of 2 mm to a minimum diameter of 1 micron, with the addition of up to 3 wt % fiberglass cut to lengths between 12.67–3.175 mm. Said polymer composite materials of special characteristics and properties, are judiciously applied, as needed, to the volumes and in the locations of the most highly stressed areas of the cell (thermal or stress of any other origin) as shown in the finite element structural analysis, replacing in those areas the corresponding volume of polymer concrete having low-resin content that is the primary constituent of the structural core of the cell receptacle. Said structural core is monolithically formed as a three-layered polymer composite material in the cell receptacle, in other words, the surfaces of the structural core material are covered inside and out with fiber-reinforced polymer composite materials acting as continuous "seals," forming a monolithic unit in both the configuration for electrowinning and for electrorefining, due to the fact that the three-layered structural material cures chemically and simultaneously as a single polymer composite material. This monolithic, three-layered polymer material is what is ultimately claimed as part of the overall set of coherent claims that includes the design, material, mold, and manufacturing process for receptacles and cells of the invention.

The reason for inclusion and description of the three-layered polymer composite material in the patent for the innovative cell is to describe:

The construction of a cell receptacle that incorporates "seals" in the form of layers (18) of fiberglass-reinforced vinyl ester resin coatings designed according to current DIN and/or ASTM standards, and integrally applied to the surfaces of the structural core of the cell receptacle, which is a highly compacted polymer concrete, with very low porosity and permeability (19); in order to protect it and ensure impermeability of the cell receptacle, the seals are functionally designed according to the degrees of corrosion resistance and impermeability required in the user's specifications as needed by the corrosiveness of the electrolytes and the aggressive nature of the processes used to clean the electrolytic cells. The inner surfaces of walls (2) and (3) and bottom (6) of cell (1) are in permanent contact with chemically aggressive, hot electrolytes, and in the manufacture of receptacles, at least three layers of fiberglass-reinforced vinyl ester resin coating must be applied to the polymer concrete core, according to current standards, although this does not restrict the number of layers applied during manufacture to part or all of the surfaces in contact with the electrolyte. The outer surfaces of walls (4) and (5) and bottom (6) of cell (1) are exposed to the environment and to accidental spills of electrolytes, hence, they normally require a lower level of protection, which may be reasonably ensured by applying at least one layer of veil fiber saturated with vinyl ester resin only on the outer surfaces of the cell walls.

The advantages and consequences of using a polymer concrete material that is formulated with a lower resin content than in the current state of the art for the structural core of cells include:

Lower raw materials costs in the manufacture of cells.

Higher and more stable average mechanical properties (ultimate resistance to compression and bending-tensile stresses).

Significant decrease in the coefficient of thermal expansion for the polymer concrete material, which is a critical and determining factor of the stresses generated by temperature gradients in the structural core of the cell at operating temperatures. The formulation for the structural core material is claimed with a 9.5% maximum resin content, which corresponds to a coefficient of thermal expansion less than $16\times10^{-6}\times K^{-1}$, i.e., a reduction on the order of 10–20% relative to the typical coefficient of thermal expansion for polymer concrete material formulations claimed in conventional, less advanced cells (for example, (Chilean) Patent No. 38,151 and (Chilean) Patent No. 35,446).

Similarly, the lower resin content results in an increase in the Young's modulus of the material. The higher the modulus, the greater the rigidity as elongation decreases and impact resistance decreases. To improve impact resistance, filament-shaped reinforcement is added to the aggregate system. It must be emphasized that in the surroundings of electrolytic cell operations the greatest stresses on the structural core are those generated by thermal gradients between the internal and external temperatures of the walls and bottom; hence the need to alleviate in practice certain relatively negative effects of the higher modulus, which increases the ultimate resistance of the material of the structural core at the same time that it increases its susceptibility to breakage. On the one hand, the formulation for the polymer concrete material of the electrolytic cells of the invention is naturally aimed at achieving a balance by mixing the vinyl ester resin of the system of resins with compatible high elongation resins, partly compensating for the higher modulus of the polymer composite material with the greater elasticity of the system of resins; and, at the same time, reducing the setting contraction of the material, which is extremely significant in reducing the overall state of internal stress remaining in the polymer concrete of the invention after solidification. The decrease in the resin content also significantly increases the thermal conductivity of the polymer concrete of the invention, and thereby decreases the thermal gradients through the walls and bottoms of electrolytic cells. On the other hand, the multi-layered coating of reinforcement/inner seal inner of the receptacle has a lower Young's modulus than the polymer concrete structural core, and it is also possible to judiciously replace volumetric contents of the polymer concrete structural core having a low resin content in areas of high stress in the cell with polymer composite materials having a high resin content and reinforced with fiberglass and fine aggregates, and accordingly, with a lower Young's modulus, high coefficient of thermal expansion, and increased impact resistance and tension resistance.

The objectives of the judicious application of polymer composite material with a higher resin content and reinforced with fiberglass and fine aggregates include:

At normal cell operating temperatures, to judiciously eliminate the areas of high tensile stress in the cell, transforming them into areas of lower or neutral tensile stress, or, one would hope, of compression.

To significantly increase the overall relaxation of stresses in the structural material core of the cell, thereby improving its safety factor in regard to impact both during shipping and handling, and during normal operations when faced with localized point thermal shock events, such as hosing the inside of the hot cell with cold water (10° C.) immediately after emptying, or severe mechanical impact caused by falling electrodes.

According to FIG. 13, the manufacturing method for an electrolytic cell (1) consists of using steel molds (19) for conventional inverted molding, but constructed with all the interior and exterior vertices of the vertical intersections of the walls between themselves and of the horizontal intersections of the walls with the bottom of the cell designed to have one or more radii (20) and/or one or more straight segments, with sufficient curvature, preferably never less than the thickness of the bottom of the cell. In order to mold the exterior curvature at the horizontal vertices of the walls with the bottom, the molds for the side walls (21) and (22) are constructed in two sections:

The first mold section is limited in height to where the curves commence, and the second mold section, which is mounted to fit on top of the other section, determines the outer curves and the pedestals for horizontal support (10) of the cell receptacle (1), which retain the edge and have no horizontal curvature.

Installed in the second mold section (FIG. 14), before assembly, is the pre-woven mesh (23) for bidirectional reinforcement, formed (FIG. 19) of fiberglass rods that are square or hexagonal in cross section and twisted, or circular in cross section with helicoidal braiding (23*a*), pultruded with vinyl ester resin and joined with resin at the points of intersection in order to maintain the integrity of the carcass (24), which covers the outer surface of the bottom of the cell (6) with a lattice whose mesh is preferably 200×200 mm; and covers the side and end walls with a mesh of preferably 600×600 mm installed just below the upper edge of the side walls. When the second mold section is filled with polymer concrete, the thickness of the polymer concrete over the pre-woven bidirectionally reinforced mesh (24) on the bottom is controlled so that it remains lodged in the plane with the maximum stresses on the bottom, as indicated by structural analysis using the finite element method.

In the current state of the art, each of the 4 molds for the side and front walls of the cell are separately covered with seals and then assembled together, and after being assembled are fixed vertically on the central core mold in an inverted position, thereby producing a perimetric 90° joint at the contact vertices of the assembled mold for the side and end walls with the core. This mold design and assembly process definitely introduces the possibility that the molded cells will have dimensional variations, as well as being out-of-square. In addition, the joined side and end walls do not ensure continuity of the seal nor impermeability of the cell on the exterior vertical vertices, which are generally the areas where contracting stresses concentrate during setting. Finally, the joint between the molds at the vertex of contact is typically not watertight when the receptacle is molded, and when the receptacle material is emptied, resin tends to leak from the vertices, thereby producing defective localized polymer concrete due to lack of resin, particularly at the upper horizontal edge of the cell walls, which is the edge most exposed to impact overloads. The correction of all these manufacturing defects requires costly rework repairs at the factory and on site.

In the proposed molding process, side molds (21) and (22) are mounted before applying the outer seal coating (18), thereby ensuring perfect squareness and continuity of the seal and impermeability over the entire surface perimeter (2), (3), (4), and (5) of cell (1). Incorporated in the core mold for the cell of the invention is a contoured section for the upper horizontal edge of the side and end walls of the cell (FIG. 15), and the perimetric joint creates the vertical position stop between the core and the lower side mold. The seal on this single joint is completely leak proof and can be checked before emptying to prevent any resin loss. Just as important as the above is the fact that the multilayered seal coatings applied to the core mold are totally continuous and the inside of the cell is a single piece, and that they extend from the inside of the receptacle over the contoured section of the upper horizontal edge of the side and end walls, always in a single piece. The beginning of the outer coating of the cell commences at the butt joint between the core and the lower side mold, and fully covers outside of the cell. The second side/bottom section (22) of the steel mold is preferably made in a single piece and covers continuously or with a drip catch (25) on the horizontal perimeter (26). In this case, the perimetric joint of seal (26) between sections (21) and (22) of the mold is reinforced by an overlap (27) of sealing material (18) that overlaps first section (2 1) and is designed according to current standards for sealing materials.

Some designs for electrolytic cells of the current state of the art, such as (Chilean) Patent No. 38,151, claim monolithic molding of an overflow box that drains out from an end wall and uses the same polymer concrete as the core, to that end integrating the mold for the overflow box into the mold for end wall (12) of the cell. The concept does not contribute any significant benefits, rather several disadvantages. It certainly makes the mold construction more expensive and makes it virtually impossible to achieve dimensions with the precise tolerances required for proper flow and the functioning of key measuring devices and electrolyte flow control devices in the overflow box, which affect both the yield of the electrolytic process and the quality of the cathode obtained. In order to compact the polymer concrete during molding, the mold for the above-mentioned overflow box of the current state of the art must be designed with obtuse angles to facilitate the release of air trapped in the concrete mixture. In addition to adding structurally unnecessary volume, this concept also results in incomplete venting of the material in the area of the overflow box and/or, worse, in the concentration of excess mass of polymer concrete which generates uneven contractions between the overflow box and the end wall of the cell receptacle during hardening, particularly at the vertices. The overflow box is an area where cracks, visual defects, voids, etc., typically occur, which require costly repair. In the design of the improved cell receptacle of the invention, the receptacle accessories are made separately, although the polymer composite material of the overflow box and the other accessories are also a three-layered monolithic similar to that of the cell. The molding, forming, and curing of the overflow box is independent from the receptacle; and its later installation, positioned to drain out typically from the end wall for electrowinning processes or typically draining out vertically toward the ground through the inside of the wall for electrorefining. It is assembled by fitting the overflow box (FIGS. 5A and 5B) finished with a wedge piece into the end wall provided with a semicircular dovetail that is formed on under the upper edge of one end wall of the cell, with later chemical adhesion, using vinyl ester resin, at the matching joint between the wall of the cell and the overflow box; and finally, sealing the completed joint by joining the layers of the corresponding seal coatings (5*b*) on the cell receptacle and on the overflow box with overlapping of the respective layers of fiberglass saturated with vinyl ester resin according to ASTM or DIN standards. The entire seal is subsequent to fitting and chemically adhering overflow box (5*a*) to cell receptacle (1), which correctly resolves all the mentioned disadvantages and ensures a virtually absolute degree of impermeability and resistance to corrosion.

What is claimed is:

1. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle; and the seismic-resistance support system further comprising supports extending outward from the bottom of the exterior portion of the electrolytic cell receptacle, and seismic fuses connected to the supports, the seismic fuses restricting movement of the electrolytic cell receptacle and adapted to break before the side walls and the bottom of the electrolytic cell receptacle when the electrolytic cell receptacle is subjected to seismic forces.

2. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the overflow and drainage system comprises a box attached to one of the side walls, said box located near the opening of the electrolytic cell receptacle, with a substantially planar wall portion adapted to mate with an aperture in one of the side walls, wherein an interface between the wall portion of the box and the aperture in one of the side walls is a dovetail joint.

3. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the overflow and drainage system comprises a box attached to one of the side walls, the box located near the opening of the electrolytic cell receptacle and the box of the overflow and drainage system is attached to one of the side walls using a vinyl ester resin.

4. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the overflow and drainage system comprises:

an insert installed in an aperture in one of the side walls a buffer block extending outward from the insert and from the interior portion of the electrolytic cell receptacle, the buffer block located near the opening of the electrolytic cell receptacle;

an end block located on the bottom of the electrolytic cell receptacle;

a drain pipe slidably mounted in holes formed in the buffer block and the end block; and a conical resilient ring disposed within the hole in the end block, the conical resilient ring forming a seal between the drain pipe and the end block;

wherein the bottom of the electrolytic cell receptacle has a drain hole in substantial alignment with the hole in the end block, and the drain pipe provides access to the drain hole when the drain pipe is positioned within the end block.

5. The electrolytic cell receptacle of claim 4, wherein an interface between the insert and the aperture in one of the side walls is a dovetail joint.

6. The electrolytic cell receptacle of claim 4, wherein the insert is attached to one of the side walls using a vinyl ester resin.

7. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the electrolyte feed system comprises:

an insert installed in an aperture in one of the side walls;

a buffer block extending outward from the insert and from the interior portion of the electrolytic cell receptacle, the buffer block located near the opening of the electrolytic cell receptacle;

an end block located on the bottom of the electrolytic cell receptacle, the end block having a port in fluid communication with a source of electrolyte; and a feed pipe mounted in holes formed in the buffer block and the end block, the hole in the end block being in fluid communication with the port in the end block, thereby allowing the feed pipe to access the source of electrolyte.

8. The electrolytic cell receptacle of claim 7, wherein an interface between the insert and the aperture in one of the side walls is a dovetail joint.

9. The electrolytic cell receptacle of claim 7, wherein the insert is attached to one of the side walls using a vinyl ester resin.

10. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle; and wherein at least a portion of the polymer concrete is reinforced with a pre-woven mesh.

11. The electrolytic cell receptacle of claim 10, wherein the pre-woven mesh comprises fiberglass rods with helicoidal braiding.

12. The electrolytic cell receptacle of claim 10, wherein the pre-woven mesh comprises corrosive-resistant fiberglass rods coated with vinyl ester resin.

13. The electrolytic cell receptacle of claim 10, wherein the bottom of the electrolytic cell receptacle is reinforced with a portion of the pre-woven mesh.

14. The electrolytic cell receptacle of claim 13, wherein the portion of the prewoven mesh that reinforces the bottom of the electrolytic cell receptacle has about a 200 mm by 200 mm mesh size.

15. The electrolytic cell receptacle of claim 10, wherein at least one of the side walls of the electrolytic cell receptacle is reinforced with a portion of the pre-woven mesh.

16. The electrolytic cell receptacle of claim 15, wherein the portion of the pre-woven mesh that reinforces at least one of the side walls of the electrolytic cell receptacle has about a 600 mm by 600 mm mesh size.

17. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

further comprising a protective surface disposed on the interior portion of the electrolytic cell receptacle, the protective surface comprising at least three layers of a seal coating material, the seal coating material being a polymer composite.

18. The electrolytic cell receptacle of claim 17, wherein the seal coating material comprises a vinyl ester resin reinforced with glass fiber.

19. The electrolytic cell receptacle of claim 17, wherein the seal coating material exhibits elongation and tensile strength greater than the polymer concrete following solidification.

20. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle; and further comprising a protective surface disposed on the exterior portion of the electrolytic cell receptacle, the protective surface comprising at least one layer of a seal coating material.

21. The electrolytic cell receptacle of claim 20, wherein the seal coating material comprises glass fiber saturated with a vinyl ester resin.

22. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the unsolidified polymer concrete comprises reinforcing solids and a liquid resin, the liquid resin comprising at most about 9.5 percent by weight of the unsolidified polymer concrete;

wherein the liquid resin includes a vinyl ester resin comprising at least about ninety percent by weight of the liquid resin; and wherein the liquid resin has an elongation of at least about 5 percent when cured.

23. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the unsolidified polymer concrete comprises reinforcing solids and a liquid resin, the liquid resin comprising at most about 9.5 percent by weight of the unsolidified polymer concrete;

wherein the liquid resin includes a vinyl ester resin comprising at least about ninety percent by weight of the liquid resin; and wherein the liquid resin comprises one or more resins compatible with the vinyl ester resin, the one or more resins having greater elongation than the vinyl ester resin when cured.

24. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the unsolidified polymer concrete comprises reinforcing solids and a liquid resin, the liquid resin comprising at most about 9.5 percent by weight of the unsolidified polymer concrete;

wherein the reinforcing solids include siliceous aggregate, wherein the siliceous aggregate have particles sizes ranging from about one micron to at least about ten mm.

25. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first cured surfaces extending upward from the bottom of the electrolytic cell receptacle to an opening of the electrolytic cell receptacle;

wherein the unsolidified polymer concrete comprises reinforcing solids and a liquid resin, the liquid resin comprising at most about 9.5 percent by weight of the unsolidified polymer concrete;

wherein the reinforcing solids include siliceous aggregate; and wherein the siliceous aggregate comprises a continuous grading based on diameter.

26. The electrolytic cell receptacle of claim 25 wherein the siliceous aggregate have particle sizes ranging from about one micron to at least about 10 mm.

27. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed system, and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

wherein the unsolidified polymer concrete comprises reinforcing solids and a liquid resin, the liquid resin comprising at most about 9.5 percent by weight of the unsolidified polymer concrete; and wherein the polymer concrete has a coefficient of thermal expansion less than about $16\times10^{-6}$ $K^{-1}$.

28. In an electrolytic cell receptacle for electrowinning or electrorefining of nonferrous metals, the electrolytic cell receptacle having side walls and a bottom extending between the side walls, said bottom and side walls of the electrolytic cell receptacle comprised of a polymer concrete and having substantially planar surfaces defining interior and exterior portions of the electrolytic cell receptacle, wherein at least a portion of the polymer concrete is reinforced with a pre-woven mesh, the electrolytic cell receptacle also having an overflow and draining system, and electrolyte feed systems and a seismic-resistance support system, wherein the improvement comprises:

first curved surfaces located on the interior portion of the electrolytic cell receptacle, the first curved surfaces defining intersections between adjacent side walls, each of the first curved surfaces extending upward from the bottom of the electrolytic cell receptacle to an opening of the electrolytic cell receptacle;

further comprising a polymer composite material located at one or more regions of highest stress in the electrolyte cell, the polymer composite material having a vinyl ester resin content of at least about fifteen percent by weight;

wherein the polymer composite material further comprises siliceous aggregate; and, wherein the siliceous aggregate have particles sizes ranging from about one micron to at least about two mm.

29. The electrolytic cell receptacle of claim 28, wherein the siliceous aggregate comprises a continuous grading based on diameter.

30. The electrolytic cell receptacle of claim 29, wherein the siliceous aggregate have particles sizes ranging from about one micron to at least about two mm.

31. A method of making an electrolytic cell receptacle having side walls and a bottom extending between the side walls, the side walls and the bottom of the electrolytic cell receptacle comprised of a polymer concrete and having substantially planar surfaces defining interior and exterior portions of the electrolytic cell receptacle, the method comprising:

providing an unsolidified polymer concrete;

shaping the unsolidified polymer concrete by introducing the unsolidified polymer concrete in a mold, the mold having an inner core for forming the interior portion of the electrolytic cell receptacle, outer walls for forming the side walls of the exterior portion of the electrolytic cell receptacle, and a top for forming the bottom of the exterior portion of the electrolytic cell receptacle, the inner core and the top of the mold adapted to form curved surfaces defining intersections between adjacent walls of the electrolytic cell receptacle and between individual walls and the bottom of the electrolytic cell receptacle;

allowing the unsolidified polymer concrete to solidify following shaping; and, wherein the outer walls of the mold used to shape the unsolidified polymer concrete have supports for receiving external vibrators.

32. A method of making an electrolytic cell receptacle having side walls and a bottom extending between the side walls, the side walls and the bottom of the electrolytic cell receptacle comprised of a polymer concrete and having substantially planar surfaces defining interior and exterior portions of the electrolytic cell receptacle, the method comprising:

providing an unsolidified polymer concrete;

shaping the unsolidified polymer concrete by introducing the unsolidified polymer concrete in a mold, the mold having an inner core for forming the interior portion of the electrolytic cell receptacle, outer walls for forming the side walls of the exterior portion of the electrolytic cell receptacle, and a top for forming the bottom of the exterior portion of the electrolytic cell receptacle, the inner core and the top of the mold adapted to form curved surfaces defining intersections between adjacent walls of the electrolytic cell receptacle and between individual walls and the bottom of the electrolytic cell receptacle;

allowing the unsolidified polymer concrete to solidify following shaping; and, further comprising installing a pre-woven mesh within the mold for reinforcement of the electrolyte cell.

33. The method of claim 32, wherein at least a portion of the pre-woven mesh is installed adjacent to the top of the mold.

34. The method of claim 32, wherein at least a portion of the pre-woven mesh is installed adjacent to the walls of the mold.

35. A method of making an electrolytic cell receptacle having side walls and a bottom extending between the side walls, the side walls and the bottom of the electrolytic cell receptacle comprised of a polymer concrete and having substantially planar surfaces defining interior and exterior portions of the electrolytic cell receptacle, the method comprising:

providing an unsolidified polymer concrete;

shaping the unsolidified polymer concrete by introducing the unsolidified polymer concrete in a mold, the mold having an inner core for forming the interior portion of the electrolytic cell receptacle, outer walls for forming the side walls of the exterior portion of the electrolytic cell receptacle, and a top for forming the bottom of the exterior portion of the electrolytic cell receptacle, the inner core and the top of the mold adapted to form curved surfaces defining intersections between adjacent walls of the electrolytic cell receptacle and between individual walls and the bottom of the electrolytic cell receptacle;

allowing the unsolidified polymer concrete to solidify following shaping; and, further comprising the inner core of the mold with at least three layers of a seal coating material before introducing the unsolidified polymer concrete in the mold, the seal coating material forming a protective surface on the interior portion of the electrolytic cell receptacle.

36. A method of making an electrolytic cell receptacle having side walls and a bottom extending between the side walls, the side walls and the bottom of the electrolytic cell receptacle comprised of a polymer concrete and having substantially planar surfaces defining interior and exterior portions of the electrolytic cell receptacle, the method comprising:

providing an unsolidified polymer concrete;

shaping the unsolidified polymer concrete by introducing the unsolidified polymer concrete in a mold, the mold having an inner core for forming the interior portion of the electrolytic cell receptacle, outer walls for forming the side walls of the exterior portion of the electrolytic cell receptacle, and a top for forming the bottom of the exterior portion of the electrolytic cell receptacle, the inner core and the top of the mold adapted to form curved surfaces defining intersections between adjacent walls of the electrolytic cell receptacle and between individual walls and the bottom of the electrolytic cell receptacle;

allowing the unsolidified polymer concrete to solidify following shaping;

further comprising introducing a polymer composite material in one or more regions of the mold corresponding to regions of highest stress in the electrolyte cell, the polymer composite material having a vinyl ester resin content of at least about fifteen percent by weight; and, further comprising identifying the one or more regions of the mold corresponding to regions of highest stress in the electrolytic cell receptacle using a finite element method of structural analysis.

37. The method of claim 36, wherein the finite element method accounts for temperature differences across the side walls and the bottom of the electrolytic cell receptacle resulting from intended operation conditions.

* * * * *

UNITED STATES PATENT AND TRADEMARK OFFICE

CERTIFICATE OF CORRECTION

PATENT NO. : 6,572,741 B1
DATED : June 3, 2003
INVENTOR(S) : Victor H. Vidaurre et al.

It is certified that error appears in the above-identified patent and that said Letters Patent is hereby corrected as shown below:

Title page,
Item [12], should be -- Vidaurre H., et al. --.
Item [76], change "Montecasion" to read -- Montecasino --

Signed and Sealed this

Sixteenth Day of September, 2003

JAMES E. ROGAN
*Director of the United States Patent and Trademark Office*